US007866709B2

(12) United States Patent
Spieth et al.

(10) Patent No.: US 7,866,709 B2
(45) Date of Patent: Jan. 11, 2011

(54) CROSSTALK DEVICE FOR AN EXHAUST SYSTEM

(75) Inventors: Arnulf Spieth, Hochdorf (DE); Markus Tuech, Bad Ueberkingen (DE); Michael Krause, Bodenheim (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 1093 days.

(21) Appl. No.: 11/599,539

(22) Filed: Nov. 14, 2006

(65) Prior Publication Data

US 2007/0107707 A1 May 17, 2007

(30) Foreign Application Priority Data

Nov. 16, 2005 (DE) ..... 10 2005 055 046

(51) Int. Cl.
*F16L 39/00* (2006.01)

(52) U.S. Cl. ..... 285/124.2; 285/65; 285/124.1

(58) Field of Classification Search ..... 285/65, 285/70, 124.1, 124.2, 124.3, 124.4, 124.5, 285/125.1, 126.1, 130, 130.1; 403/177; 123/568.17; 454/63, 64
See application file for complete search history.

(56) References Cited

U.S. PATENT DOCUMENTS

| | | | | | |
|---|---|---|---|---|---|
| 814,217 | A | * | 3/1906 | Knight et al. | 285/149.1 |
| 1,231,928 | A | * | 7/1917 | Miller et al. | 122/360 |
| 2,230,306 | A | * | 2/1941 | McDonald | 285/61 |
| 2,518,292 | A | * | 8/1950 | De Anglis | 405/47 |
| 2,518,620 | A | * | 8/1950 | Hughes | 210/239 |
| 3,577,105 | A | * | 5/1971 | Jones, Jr. | 333/239 |
| 3,736,955 | A | * | 6/1973 | Schlesser | 137/561 A |
| 4,130,303 | A | * | 12/1978 | George | 285/130.1 |
| 4,650,222 | A | * | 3/1987 | Cetrone | 285/124.4 |
| 4,708,372 | A | * | 11/1987 | Arima et al. | 285/130.1 |
| 4,870,961 | A | * | 10/1989 | Barnard | 128/202.27 |
| 4,900,065 | A | * | 2/1990 | Houck | 285/73 |
| 4,982,736 | A | * | 1/1991 | Schneider | 607/104 |
| 5,015,013 | A | * | 5/1991 | Nadin | 285/64 |
| 5,188,427 | A | * | 2/1993 | LeBegue et al. | 299/12 |
| 5,354,101 | A | * | 10/1994 | Anderson, Jr. | 285/25 |
| 5,462,312 | A | * | 10/1995 | Carpenter et al. | 285/15 |

(Continued)

FOREIGN PATENT DOCUMENTS

DE 1 878 226 8/1963

(Continued)

OTHER PUBLICATIONS

European Search Report dated Jan. 15, 2007 for related European Application No. EP 06 12 2634.

*Primary Examiner*—James M Hewitt
(74) *Attorney, Agent, or Firm*—Howard IP Law Group, PC

(57) ABSTRACT

A crosstalk device for coupling of two exhaust lines of an exhaust system of an internal combustion engine through which exhaust can flow in parallel has a housing having two inlets and two outlets that are connected so they communicate through an interior space of the housing and by which the two exhaust lines can be connected to the crosstalk device. The crosstalk device has an inexpensive design and high stability because its housing is assembled from two half-shells whose parting plane extends across the main direction of flow of the crosstalk device.

19 Claims, 4 Drawing Sheets

U.S. PATENT DOCUMENTS

| | | | | |
|---|---|---|---|---|
| 5,507,529 | A * | 4/1996 | Martins | 285/26 |
| 5,556,138 | A * | 9/1996 | Nakajima et al. | 285/124.4 |
| 5,740,671 | A | 4/1998 | Jones | |
| 5,860,677 | A * | 1/1999 | Martins et al. | 285/26 |
| 6,481,756 | B1 * | 11/2002 | Field et al. | 285/124.1 |
| 6,648,375 | B1 * | 11/2003 | Panek | 285/124.1 |
| 6,672,627 | B1 * | 1/2004 | Mariman et al. | 285/124.1 |
| 6,866,300 | B2 * | 3/2005 | Hayes et al. | 285/124.2 |
| 7,021,336 | B2 * | 4/2006 | Burrows et al. | 138/39 |
| 7,021,671 | B2 * | 4/2006 | Evans | 285/125.1 |
| 7,055,864 | B2 * | 6/2006 | Pelfrey et al. | 285/124.5 |
| 7,083,202 | B2 * | 8/2006 | Eberle et al. | 285/124.4 |
| 7,156,423 | B2 * | 1/2007 | Marks | 285/21.1 |
| 7,438,326 | B1 * | 10/2008 | Meyers | 285/133.11 |
| 7,464,966 | B2 * | 12/2008 | Miyajima et al. | 285/124.3 |
| 7,604,258 | B2 * | 10/2009 | Getto et al. | 285/124.2 |
| 2002/0008384 | A1 * | 1/2002 | Potts et al. | 285/124.1 |
| 2002/0117850 | A1 * | 8/2002 | Wood et al. | 285/124.1 |
| 2003/0080554 | A1 * | 5/2003 | Schroeder et al. | 285/125.1 |
| 2003/0192598 | A1 * | 10/2003 | Hobson et al. | 137/561 A |
| 2004/0201212 | A1 * | 10/2004 | Marks | 285/124.1 |
| 2005/0212287 | A1 * | 9/2005 | Caro | 285/125.1 |
| 2008/0219753 | A1 * | 9/2008 | Orava | 403/32 |
| 2009/0001715 | A1 * | 1/2009 | Skiba et al. | 285/124.3 |

FOREIGN PATENT DOCUMENTS

| | | |
|---|---|---|
| GB | 995528 | 6/1965 |
| GB | 1104020 | 2/1968 |
| GB | 2161215 | 1/1986 |

* cited by examiner

CROSSTALK DEVICE FOR AN EXHAUST SYSTEM

FIELD OF THE INVENTION

The invention relates to a crosstalk device for fluidic and/or acoustic coupling of two exhaust lines of an exhaust system of an internal combustion engine through which exhaust gas can flow in parallel. The invention also relates to a dual-flow exhaust system equipped with such a crosstalk device.

BACKGROUND OF THE INVENTION

Crosstalk devices are used for influencing the acoustics of dual-flow exhaust systems, i.e., in exhaust systems having two exhaust lines through which the exhaust gas can flow in parallel. Airborne sound conveyed in one exhaust line is introduced into the other exhaust line and vice versa. Such crosstalk devices are exposed to high thermal and mechanical stresses during operation of the exhaust system, attributable in particular to the fact that the two exhaust lines that are linked together mechanically, and also via the crosstalk device, are exposed to different stresses.

SUMMARY OF THE INVENTION

The present invention relates to the problem of providing a crosstalk device which is inexpensive to manufacture and has relatively high fatigue strength.

The invention is based on the general idea of assembling the housing of a crosstalk device having two inlets and two outlets from two half-shells, such that their parting plane extends across the main direction of flow of the crosstalk device. Due to the selected embodiment of the half-shells and/or due to the resulting orientation of the parting plane, a stress distribution can be achieved in the crosstalk device such that it puts comparatively little stress on the fastening by means of which the two half-shells are fastened to one another. Furthermore, the crosstalk device may be designed to be very compact and at the same time to have a high rigidity in this design. For example, the half-shells may be designed as sheet metal parts that are manufactured by shaping.

The proposed design also results in the fact that the parting plane does not extend through the two inlets or through the two outlets, so the inlets and outlets are each undivided. As a result, when the crosstalk device is installed in the two exhaust lines of the exhaust system, tubular bodies of the exhaust system can be attached to the inlets and to the outlets with uninterrupted welds running completely around the circumference. It is thus possible to reduce stress peaks within the welds even in the area of the inlets and in the area of the outlets, thereby increasing the fatigue strength of the crosstalk device that is tied into the exhaust system.

In an exemplary embodiment, the two half-shells are adapted so they can be inserted one inside the other in the main direction of flow through the crosstalk device, such that in the installed state, plug-in areas of the two half-shells mutually overlap. When the half-shells are stuck together, this results in doubling of the material in the area of the parting plane, which in turn results in a significant stiffening effect for the crosstalk device.

Another embodiment has the plug-in areas of the two half-shells which are adapted to be asymmetrical with regard to a dividing plane that runs perpendicular to the parting plane. The asymmetry here is designed so that an outer plug part area of the one half-shell arranged on one side of the parting plane is attached to an inner plug part area of the other half-shell on the outside, whereas an inner plug part area of the one half-shell arranged on the other side of the dividing plane is inserted into an outer plug part area of the other half-shell. One advantage of this embodiment is that it is possible to design the half-shells as identical parts. This greatly reduces the cost of manufacturing the crosstalk device.

It is self-evident that the features mentioned above and those to be explained below may be used not only in the particular combination given but also in other combinations or alone without going beyond the scope of the present invention.

BRIEF DESCRIPTION OF THE DRAWINGS

Exemplary embodiments of the invention are depicted in the drawings and explained in greater detail in the following description, where the same reference numerals are used to refer to the same or similar or functionally identical components.

DETAILED DESCRIPTION OF THE INVENTION

Figure 1:
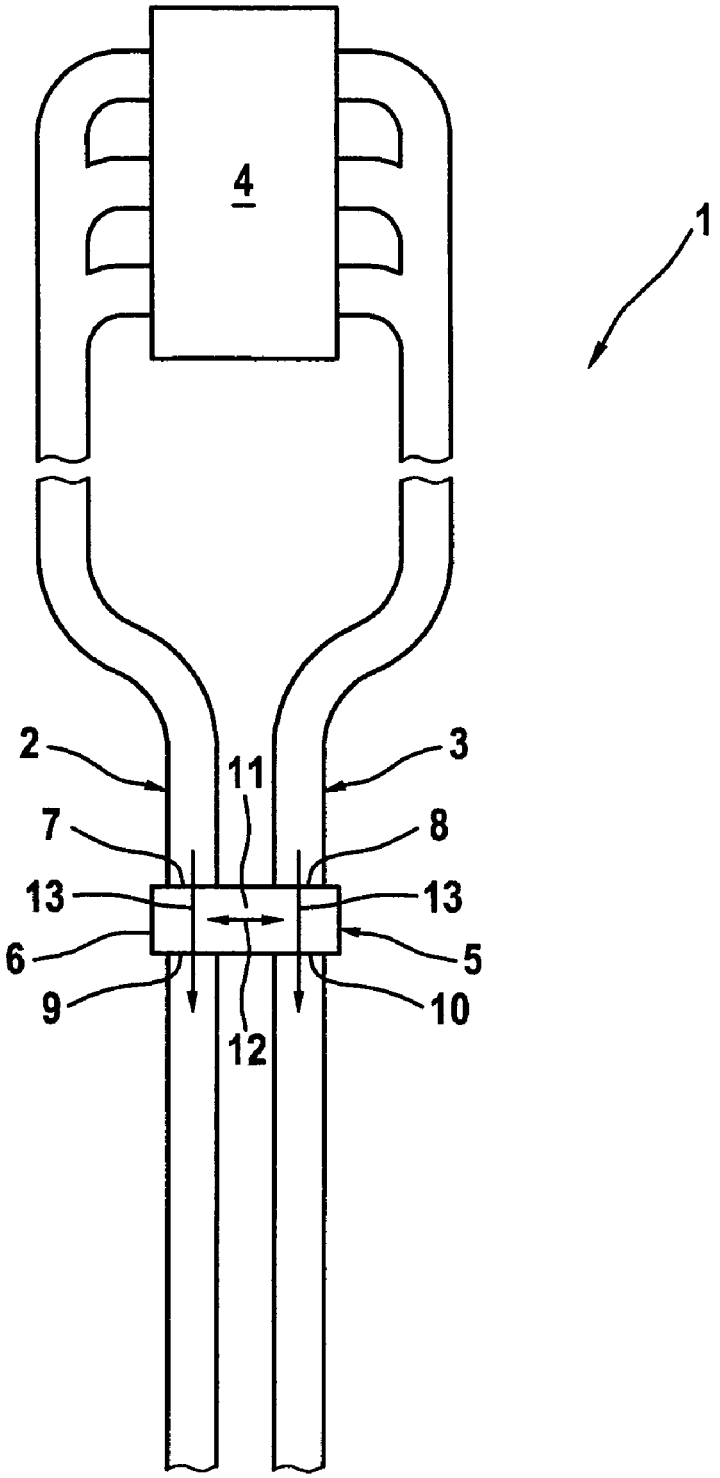
FIG. 1 is a simplified schematic diagram of an exhaust system.
Figure 2:
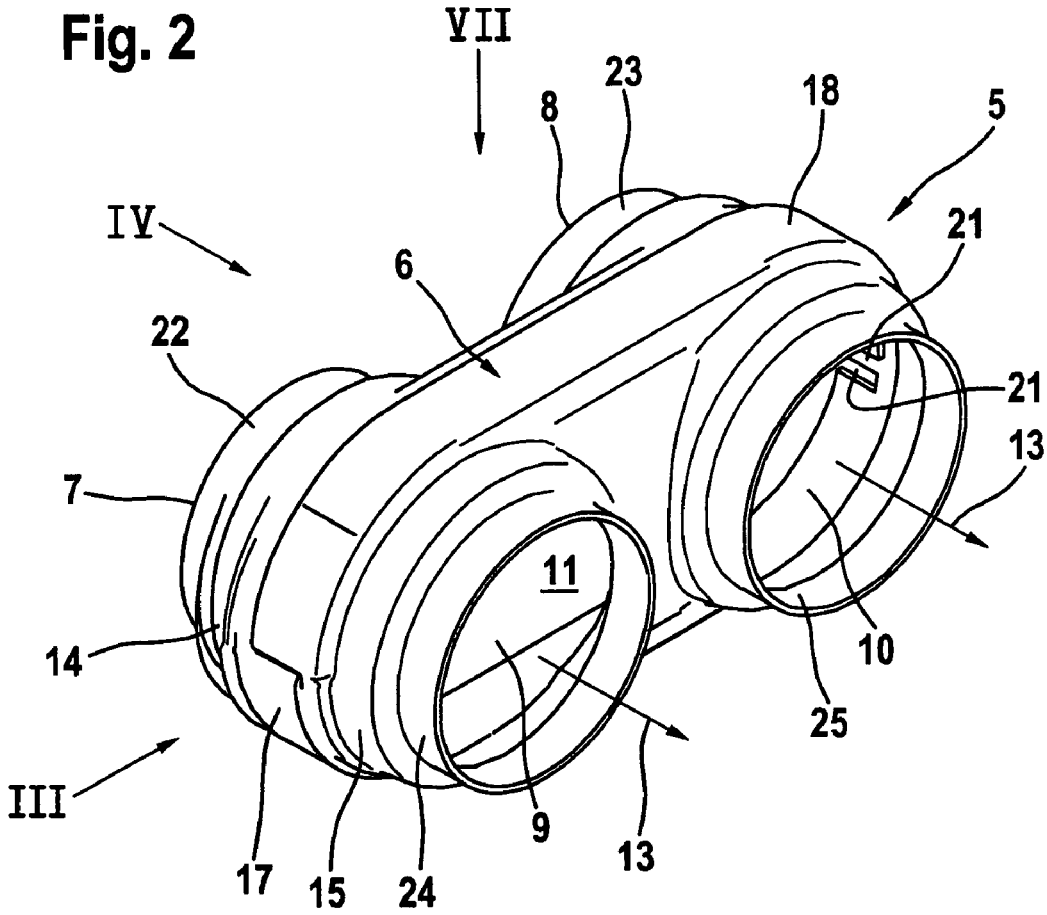
FIG. 2 is a perspective view of an crosstalk device.
Figure 3:
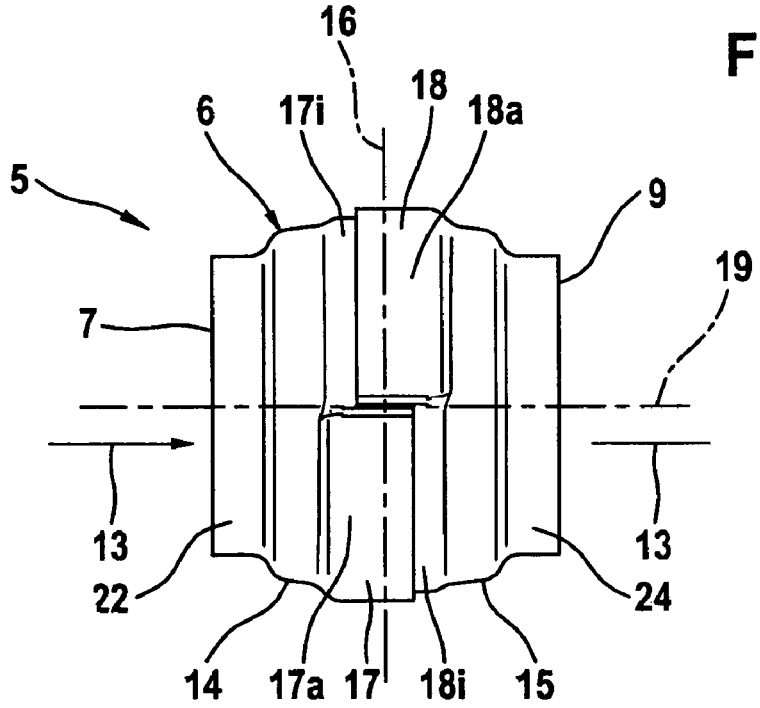
FIG. 3 is a side view of the crosstalk device according to the viewing direction III in FIG. 2.
Figure 4:
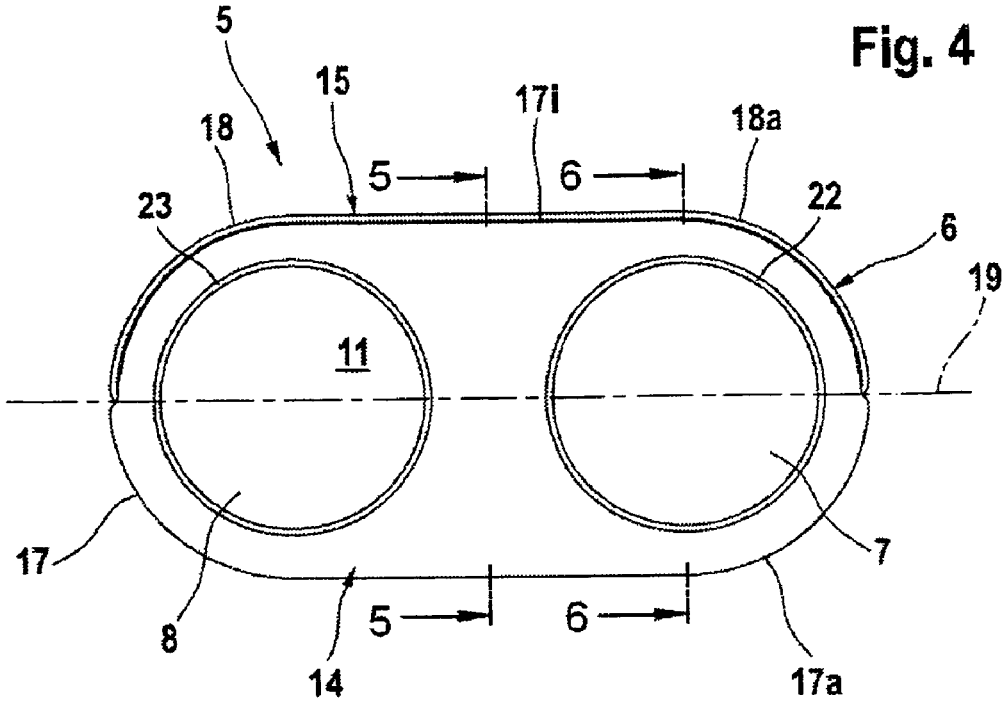
FIG. 4 is a front view or a rear view of the crosstalk device according to the viewing direction IV in FIG. 2.
Figure 5:
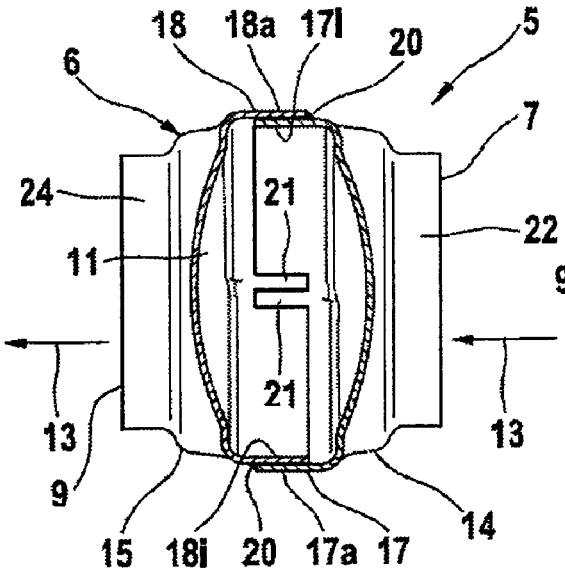
FIG. 5 is a sectional view of the crosstalk device according to the sectional lines 5-5 in FIG. 4.
Figure 6:
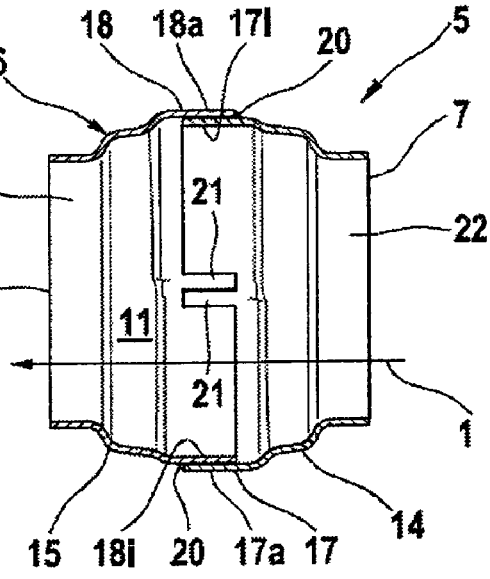
FIG. 6 is a sectional view of the crosstalk device according to sectional lines 6-6 in FIG. 4.
Figure 7:
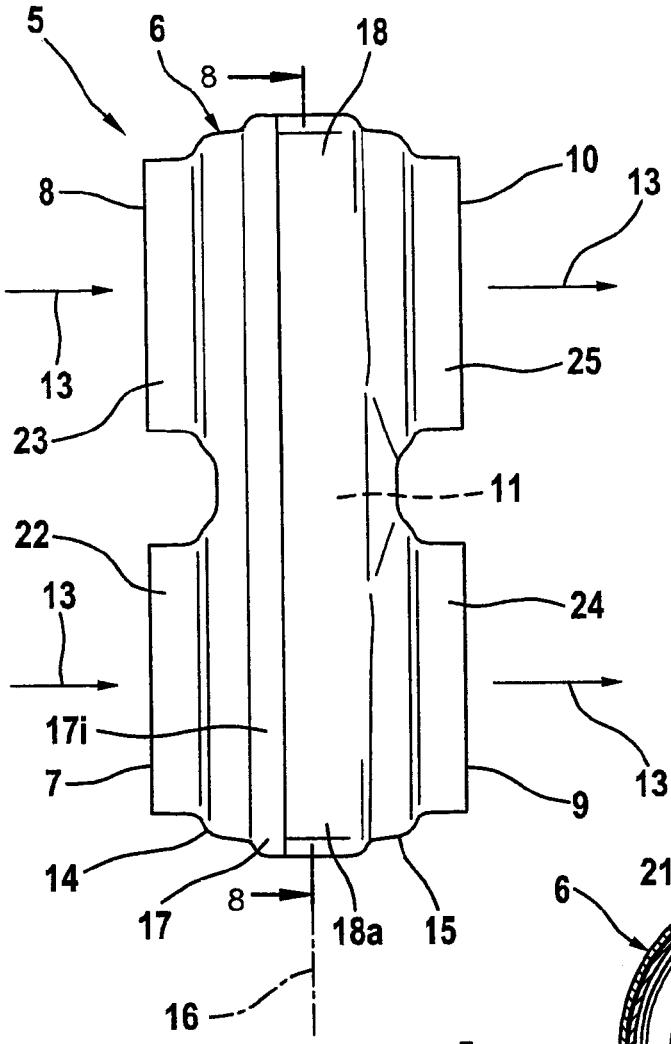
FIG. 7 is a top view of the crosstalk device according to the viewing direction VII in FIG. 2.
Figure 8:
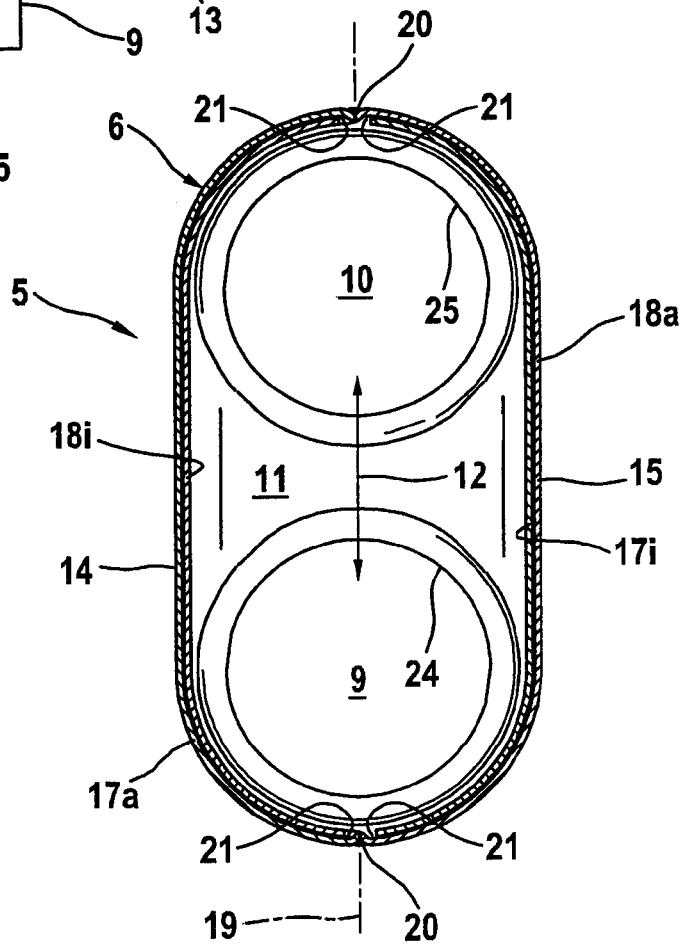
FIG. 8 is a sectional view of the crosstalk device according to sectional lines 8-8 in FIG. 7.

Referring now to FIG. 1, a dual-flow exhaust system 1 has two exhaust lines, 2 and 3. The exhaust system 1 serves to remove exhaust gases from an internal combustion engine 4. The two exhaust lines 2, 3 are connected to the internal combustion engine 4, so that exhaust gas flows through the two exhaust lines in parallel during operation of the internal combustion engine 4. The exhaust lines 2, 3 may contain equipment (not shown here) for exhaust gas purification, e.g., a catalytic converter and particulate filter as well as for noise suppression in the usual way. The internal combustion engine 4 may be arranged in a motor vehicle together with its exhaust system 1.

The exhaust system 1 also has a crosstalk device 5, which serves to fluidically and/or acoustically link the two exhaust lines 2, 3 together. The acoustic coupling causes the airborne sound that is conveyed into the exhaust lines 2, 3 during operation of the internal combustion engine 4 to go from the exhaust line 2 into the exhaust line 3 via the crosstalk device 5 and vice versa. Fundamentally, the fluidic coupling causes the exhaust, which is emitted through the exhaust lines 2, 3 during operation of the internal combustion engine 4, to be able to go from the exhaust line 2 into the exhaust line 3 via the crosstalk device 5 and vice versa. The crosstalk device 5 serves essentially to influence the exhaust system 1 acoustically.

The crosstalk device 5 has a housing 6, which has two inlets, 7 and 8, as well as two outlets, 9 and 10. In the installed state illustrated in FIG. 1, the exhaust line 2 is connected to the crosstalk device 5 via the inlet 7 and the outlet 9, while the exhaust line 3 is connected to the crosstalk device 5 via the inlet 8 and the outlet 10.

The housing 6 has an interior 11 through which the inlets 7, 8 and the outlets 9, 10 communicate fluidically with one another. Fluidic and/or acoustic coupling of the two exhaust lines 2, 3 is thus accomplished through this interior 11. The coupling, labeled as 12 in FIG. 1, is represented by a double arrow.

During operation of the internal combustion engine 4, exhaust flows through the crosstalk device 5 in the main direction of flow 13, which is represented by arrows in the figures. This main direction of flow 13 leads here from the respective inlet 7, 8 to the outlet 9 and/or 10 allocated to the same exhaust line 2, 3. The main direction of flow 13 of the crosstalk device 5 thus corresponds to the main direction of flow of the exhaust within the respective exhaust line 2, 3 in the area of the crosstalk device 5, i.e., in passing through the crosstalk device 5.

The structural details of the crosstalk device 5 are explained in greater detail below with reference to FIG. 2 through FIG. 8.

Now referring to FIG. 2 through FIG. 8, the housing 6 is assembled from two half-shells, 14 and 15. The two half-shells 14, 15 have a parting plane 16 extending across the main direction of flow 13 of the crosstalk device 5. Because of this design of the half-shells 14, 15, the half-shell 14 has both inlets 7, 8. In contrast with that, the half-shell 15 has both outlets 9, 10. The parting plane 16 thus extends between the inlets 7, 8, which are on one side of the parting plane 16, and the outlets 9, 10, which are on the other side of the parting plane 16. At the same time, the parting plane 16 extends through the interior 11.

In an exemplary embodiment illustrated here, the two half-shells 14, 15 are adapted to be inserted one into the other in the installed state shown here, namely in the main direction of flow 13 of the crosstalk device 5. This results in mutual overlap of plug-in areas, namely a plug-in area 17 of the first half-shell 14 and a plug-in area 18 of the second half-shell 15. In the overlap area formed by the plug-in areas 17, 18 plugged together, there is doubling of the material within the housing 6, leading to an intense stiffening of the housing 6 in this housing area. The parting plane 16 extends exactly in this overlap area, i.e., through the plug-in areas 17, 18.

In the exemplary embodiments shown here, the plug-in areas 17, 18 are adapted to be asymmetrical with regard to a dividing plane 19. This dividing plane 19 extends perpendicular to the parting plane 16. Along the dividing plane 19, each plug-in area 17, 18 is subdivided into an inner plug part area 17*i* and/or 18*i* arranged on one side of the dividing plane 19 and an outer plug part area 17*a* and/or 18*a* arranged on the other side of the dividing plane 19. In the assembled state, the outer plug part area 17*a* of the first half-shell 17 is thus attached to the inner plug part area 18*i* of the second half-shell 15 on the one side of the dividing plane 19, while on the other side of the dividing plane 19 the inner plug part area 17*i* of the first half-shell 14 is inserted into the outer plug part area 18*a* of the second half-shell 15 on the inside. In this embodiment, the two half-shells 14, 15 are each half-attached to the other half-shell 14, 15 in the area of their parting plane 16 and half-inserted into the other half-shell 14, 15. The embodiment shown here has the advantage that the two half-shells 14, 15 may be identical. Identical parts increase the number of parts manufactured per hour and reduce the price per part, so that the crosstalk device 5 can be manufactured especially inexpensively due to this measure.

As in the exemplary embodiments shown here, the dividing plane 19 preferably extends through both inlets 7, 8 and both outlets 9, 10. With this alignment of the dividing plane 19, forces introduced via the exhaust lines 2, 3 onto the crosstalk device 5 can be transferred especially favorably over the reinforced overlap area. It is likewise possible for the dividing plane 19 to be arranged in so that the inlet 7 and the outlet 9, both of which are assigned to the exhaust line 2, are on one side of the dividing plane 19, and the inlet 8 and the outlet 10, both of which are assigned to the outlet line 3, are on the other side of the dividing plane 19.

The two half-shells 14, 15 in the installed state of the crosstalk device 5 are preferably joined together by a single closed peripheral weld 20. The weld 20 is indicated only as an example in the sectional diagrams in FIGS. 5, 6 and 8. The weld 20 thus extends on the edge along the outer plug part areas 17*a* and 18*a*, thereby closing the slots 21 which are required to form the divided plug-in areas 17, 18 and allowing them to be inserted one into the other. The housing 6 is sufficiently tight due to the closed peripheral weld 20.

To simplify the tie-in of the crosstalk device 5 into the exhaust lines 2, 3, the two inlets 7, 8 are each preferably designed as inlet connections and the two outlets 9, 10 are each preferably designed as outlet connections. Accordingly, in the preferred embodiment shown here, an inlet connection 22, another inlet connection 23, an outlet connection 24 and another outlet connection 25 are provided. The dimensions of the connections 22 through 25 are coordinated with those of the exhaust lines 2, 3, so that the respective exhaust line 2, 3 can be either inserted into the respective connection 22 through 25 or attached onto the respective connection 22 through 25. For fastening the exhaust lines 2, 3 on the crosstalk device 5, a closed peripheral weld may be provided in the area of each connection 22 through 25. Since the inlets 7, 8 and thus the inlet connections 22, 23, like the outlet connections 9, 10 and their outlet connections 24, 25, are arranged outside of the parting plane 16, the welds may be designed for connecting the exhaust lines 2, 3 without interruption, so that they are exposed to reduced stresses during operation and have an increased fatigue strength.

The compact design of the embodiment shown here is also characterized in that both inlets 7, 8 lie in a shared inlet plane, which runs parallel to the parting plane 16 in particular. In addition, in the embodiment shown here, the two outlets 9, 10 lie in a shared outlet plane, which may run parallel to the parting plane 16. In addition, the inlet 7 and the outlet 9, both of which are allocated to the exhaust line 2, are arranged coaxially, so that the pair consisting of the inlet 7 and the outlet 9 belonging together are aligned with one another. In the embodiment shown here, the same thing is also true of the other pair that belongs together and consists of the inlet 8 and the outlet 10.

The crosstalk device 5 allows acoustic and fluidic coupling, namely pneumatic coupling here between the two exhaust lines 2, 3 via its interior space 11 when the crosstalk device 5 is installed in the exhaust system 1. In addition, the two exhaust lines 2, 3 are interconnected in a mechanically fixed manner via the crosstalk device 5. The mechanical connection between the two exhaust lines 2, 3 achieved by the crosstalk device 5 is exposed to high stresses during operation of the exhaust system 1. The design of the crosstalk device 5 shown here permits a favorable stress distribution, because the directions in which the forces occurring are transferred mainly between the two exhaust lines 2, 3 lie essentially in the parting plane 16. At the same time, the crosstalk device 5 is characterized by a particularly high stiffness owing to its design in the area of its parting plane 16. Accordingly, the crosstalk device 5 has a relatively high stability with regard to the stresses that occur.

The invention claimed is:

1. An exhaust system for an internal combustion engine comprising:

first and second parallel exhaust lines through which exhaust gas can flow and which are fluidically and acoustically linked together by means of a crosstalk device, said crosstalk device comprising: a housing having a first and a second inlet and a first and a second outlet, wherein all of said first inlet, said second inlet, said first outlet and said second outlet are interconnected to one another so they fluidically communicate with one another via an interior of said housing and by which the first and second parallel exhaust lines are connected to the crosstalk device; wherein said housing is assembled from a first and a second half-shell whose parting plane extends across the main direction of flow of the crosstalk device.

2. The exhaust system according to claim 1, wherein said first half-shell has said first and second inlets while said second half-shell has said first and second outlets.

3. The exhaust system according to claim 1, wherein said parting plane extends through said interior and wherein said first and second half-shells have first and second plug-in areas respectively.

4. The exhaust system according to claim 3, wherein said first and second half-shells in the main direction of flow of the crosstalk device are inserted one inside the other and said first and second plug-in areas of said first and second half-shells mutually overlap.

5. The exhaust system according to claim 4, wherein said first and second plug-in areas of said first and second half-shells are asymmetrical with regard to a dividing plane running perpendicular to said parting plane such that an outer plug part area of said first half-shell arranged on one side of said dividing plane is attached on the outside to an inner plug part area of said second half-shell, while an inner plug-in area of said first half-shell arranged on the other side of said dividing plane is inserted on the inside into an outer plug part area of said second half-shell.

6. The exhaust system according to claim 5, wherein said dividing plane extends between said first inlet and said first outlet, which are assigned to said first exhaust line, and said second inlet and second outlet, which are assigned to said second exhaust line.

7. The exhaust system according to claim 5, wherein said dividing plane extends through both of said first and second inlets and through both of said first and second outlets.

8. The exhaust system according to claim 1, wherein said first and second half-shells are identical.

9. The exhaust system according to claim 1, wherein said first and second half-shells are attached to one another by a closed peripheral weld.

10. The exhaust system according to claim 1 wherein said first inlet is adapted to receive said first exhaust line and said first outlet is adapted to receive said second exhaust line.

11. The exhaust system according to claim 1, wherein said first inlet has a connection to attach to said first exhaust line and said first outlet has a connection to attach to said second exhaust line.

12. The exhaust system according to claim 1, wherein said first inlet is adapted to receive said first exhaust line and said second outlet has a connection to attach to said second exhaust line.

13. The exhaust system according to claim 1, wherein said first inlet has a connection to attach to said first exhaust line and said second outlet is adapted to receive said second exhaust line.

14. The exhaust system according to claim 1, wherein said first and second inlets lie in a shared inlet plane.

15. The exhaust system according to claim 14, wherein said inlet plane runs parallel to said parting plane.

16. The exhaust system according to claim 1, wherein said first and second outlets lie in a shared outlet plane.

17. The exhaust system according to claim 16, wherein said outlet plane runs parallel to said parting plane.

18. The exhaust system according to claim 1, wherein at least one of said first and second inlets and at least one of said first and second outlets assigned to said first exhaust line are arranged so that they are flush with one another.

19. The exhaust system according to claim 1, wherein at least one of said first and second inlets and at least one of said first and second outlets assigned to said first exhaust line are arranged so that they are coaxial with one another.

* * * * *